US005320022A

United States Patent [19]

Kimbro et al.

[11] Patent Number: 5,320,022

[45] Date of Patent: Jun. 14, 1994

[54] APPARATUS FOR REDUCING RECOIL AND MUZZLE CLIMB FROM DISCHARGE OF FIREARMS

[75] Inventors: Jerold R. Kimbro; James P. Kimbro, both of Coffeen, Ill.

[73] Assignee: Gunstar, Inc., Granite City, Ill.

[21] Appl. No.: 19,093

[22] Filed: Feb. 18, 1993

[51] Int. Cl.[5] ..... F41A 21/36

[52] U.S. Cl. ..... 89/14.3; 89/14.5

[58] Field of Search ..... 89/14.05, 14.1, 14.2, 89/14.3, 14.4, 14.5

[56] References Cited

U.S. PATENT DOCUMENTS

| | | | |
|---|---|---|---|
| 812,140 | 2/1906 | Kent | 89/14.3 |
| 817,134 | 4/1906 | Smith | 89/14.3 |
| 1,636,357 | 7/1927 | Cutts | 89/14.3 |
| 2,101,849 | 12/1937 | Green | 89/14.3 |
| 2,206,568 | 7/1940 | Hughes | 89/14.3 |
| 2,212,686 | 8/1940 | Hughes | 89/14.3 |
| 2,351,037 | 6/1944 | Green | 89/14.5 |
| 2,567,826 | 9/1951 | Prache | 89/14.3 |
| 2,842,024 | 7/1958 | Mutter | 89/14.3 |
| 4,852,460 | 8/1989 | Davidson | 89/14.3 |
| 5,092,223 | 3/1992 | Hudson | 89/14.2 |

*Primary Examiner*—David H. Brown

*Attorney, Agent, or Firm*—Robbins & Robbins

[57] ABSTRACT

A method and apparatus are provided for reducing the recoil and muzzle climb from the discharge of a firearm. A hollow cylinder member having a front end with a restricted opening forming a gas chamber is attached to the muzzle end of a firearm and serves to rearwardly divert the highly pressurized gas produced from the combustion of gunpowder. The cylinder member is provided with rearwardly angled holes along both its top and bottom surface which act as jets to create a forward propulsive force from the expelled gas. This forward force counteracts and reduces the backward force of the firearm's recoil. By providing a greater ratio of top holes to bottom holes, thereby effecting a downward force greater than the upward force, muzzle climb can also be effectively reduced. The apparatus can be constructed for quick attachment to the muzzle of the firearm.

6 Claims, 2 Drawing Sheets

APPARATUS FOR REDUCING RECOIL AND MUZZLE CLIMB FROM DISCHARGE OF FIREARMS

BACKGROUND OF THE INVENTION

The present invention relates to the art of firearms and is concerned with the reduction of the attendant recoil and muzzle climb upon discharge of the firearm.

Firearms necessarily require that the shot, bullet, or projectile be discharged by means of an explosive, typically by the combustion of gunpowder. Such combustion produces gases which, when confined to the limited container of the barrel, are placed under great pressure. Their buildup and explosive release create the recoil of which the shooter is keenly aware. This recoil action can deliver a substantial jolt to the shoulder of the shooter, especially with some of the larger caliber rifles and lower gauge shotguns. This is a punishment that many people do not wish to endure and, consequently, are intimidated by the prospect of shooting firearms. The recoil and muzzle climb also disturb the shooter's aim for subsequent shots.

It would be desirable to reduce the recoil from a discharged firearm so that the intimidation factor is eliminated. More people could then participate in hunting or recreational marksmanship, and shooting skills could be improved by those already experienced because they will not anticipate the recoil jolt and muzzle climb which oftentimes affects their aim and concentration.

It would be further desirable to provide an attachment for reducing the recoil from discharged firearms which can be readily installed on the end of the barrel.

SUMMARY OF THE INVENTION

By means of the instant invention there is provided a method and apparatus for reducing the recoil and other propulsive forces generated upon the combustion of gunpowder during the discharge of firearms. The method comprises diverting in a rearward direction the gas that is expelled from the muzzle of the firearm. Because recoil is effected by the equal and opposite reaction to the forward force generated by the expelled, highly pressurized gas, redirecting the gas backward as it escapes from the muzzle will create a resultant "forward recoil". This counteracts the initial recoil felt by the shooter, and reduces the net recoil thrust force. The method is most efficient if the gas is caused to pass rearwardly through restricted passages to create a jet propulsion effect. Towards this end, a cylinder member is provided under this invention for attachment to the end of the firearm for redirecting the expelled gas escaping the muzzle.

The cylinder member is hollow and has an outer wall of sufficient dimension to withstand the high pressures of the expelled gas. The front end has a restricted opening for allowing the projectile to pass, but trapping and diverting back the gas rearwardly. A plurality of apertures are located along the cylinder surface through which the diverted gas escapes. The apertures are drilled so that their axis of opening is directed rearwardly and at an angle.

Apertures are provided on opposing sides of the cylinder member to compensate for and counteract each other's respective propulsive forces to prevent overriding thrust in one direction. To counteract and reduce the muzzle climb caused by the spinning force of the projectile as it accelerates down the rifling of the barrel, a proportionately greater number of apertures are provided on the upper surface of the cylinder member.

The method and apparatus of the instant invention can be used on any firearm and the cylinder member may be scaled accordingly to accommodate various caliber firearms and loads of particular rounds. The cylinder member can be adapted to attach to the end of the muzzle of any firearm, such as by threading, welding, soldering or cross-pinning.

It is therefore an object of this invention to provide a method whereby the highly pressurized gas expelled from the muzzle of a firearm upon the combustion of gunpowder is diverted rearwardly to counteract and reduce the recoil and muzzle climb attendant upon the discharge of the firearm.

It is further an object of this invention to provide an apparatus which directs such rearwardly diverted gas through apertures to produce a jet propulsion effect in reducing the recoil from the discharged firearm.

It is still further an object of this invention to provide an apparatus for carrying out this method which can be readily attached to any firearm.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
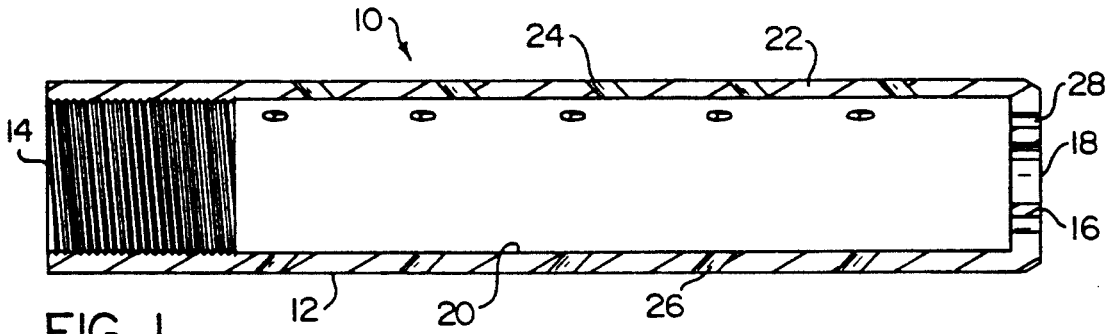
FIG. 1 is a cross sectional view from the side of the apparatus of the invention.

The apparatus of the instant invention is generally indicated by the reference numeral 10. It is comprised of cylinder member 12 made of steel, two to four inches long, having one open end 14 and a second end 16 having a restricted opening 18 as best shown in FIG. 1. Cylinder member 12 is generally hollow and forms a gas chamber 20. Cylinder wall 22 is of a thickness sufficient (i.e., 0.122 inches or other such thickness as understood by those skilled in the art) to withstand the high pressures generated by the gas produced from the combusted gunpowder.

Figure 4:
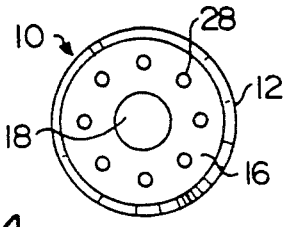
FIG. 4 is a view in side elevation from the front end of the apparatus.

A series of rearwardly directed apertures, or channels, 24 and 26 are disposed longitudinally along a top and bottom surface, respectively, of cylinder member 12. These channels are oriented such that an angle between the respective axis of a channel and axis of cylinder member 12 is between the range of 30°–60°, with the optimum angle being 49°. The diameter of these channels should be approximately 3/16 of an inch. Restricted opening 18 should have a dimension slightly larger than that of the projectile fired by the particular firearm to which the apparatus is attached, to allow the projectile to pass, but to contain and re-direct the gas. Optimally, the size of opening 18 should be 0.002–0.004 inches greater than the bore diameter of the particular firearm to which the apparatus is attached. For example, on a 0.223 caliber rifle with a bore diameter of 0.224 inches, opening 18 should be 0.226–0.227 inches; on a 6 mm rifle with a bore diameter of 0.243 inches, opening 18 should be 0.245–0.247 inches; on a 30 caliber rifle with a bore diameter of 0.308 inches, opening 18 should be 0.310–0.312 inches. Vent holes 28 are provided in circumferential arrangement around opening 18 in second end 16 of cylinder member 12 as shown in FIG. 4. These vent holes, 4–8 in number, have a diameter in the range of 1/32–⅛ inches.

Figure 6:
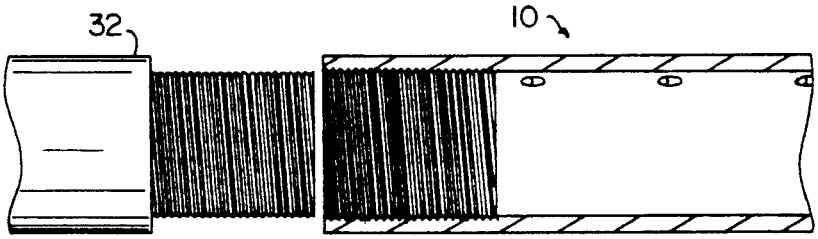
FIG. 6 is a cross sectional view of the apparatus having a threaded end for attachment to the muzzle of a firearm, namely a rifle.

Cylinder member 12 can be internally threaded at end 14 for attachment to a muzzle end having a mating thread arrangement such as shown in FIG. 6. It may be necessary to thread the end of the firearm so that it can receive cylinder member 12. Machine style threading with a crush factor of 0.003 can be used. Other means of attachment can include soldering, welding or cross-pinning, or in other manner known to a person skilled in the art.

USE

Figure 5:
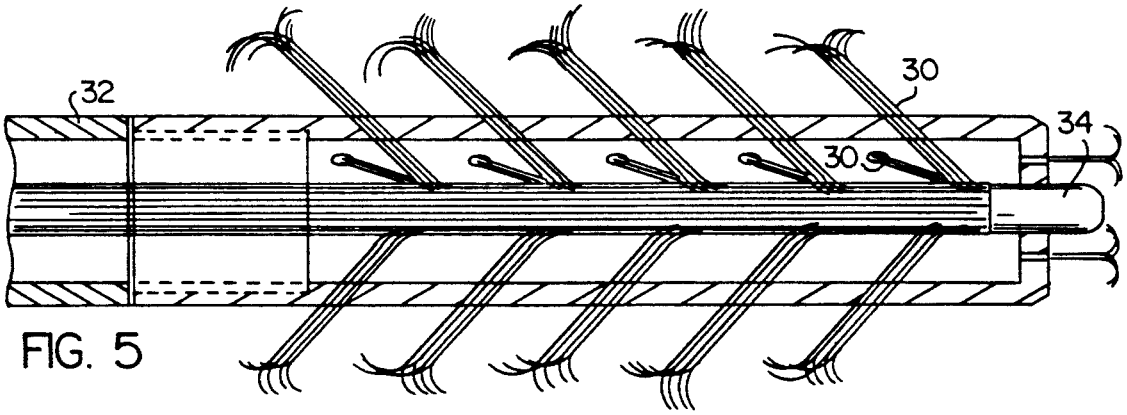
FIG. 5 is a schematic view of the direction of travel of the discharged gases effected by the apparatus after expulsion from the muzzle.

The method and apparatus of the instant invention are very simply employed by attaching apparatus 10 to the muzzle end of a firearm such as shown in FIG. 6. After the discharge of the firearm, the gas 30 produced by the combustion of the gunpowder is expelled out of the muzzle 32 as shown in FIG. 5. While projectile 34 is allowed to pass out of restricted opening 18, gas 30 is diverted back as it impinges against front end 16. The rearwardly diverted gas is directed out of channels 24 and 26, which act as jets and cause forward propulsive force. This counteracts the initial rearward recoil force created upon discharge of the firearm to create a zero net recoil.

Figure 2:
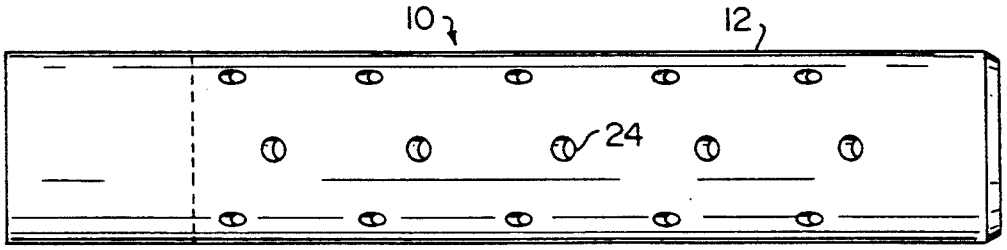
FIG. 2 is a top plan view of the apparatus.
Figure 3:
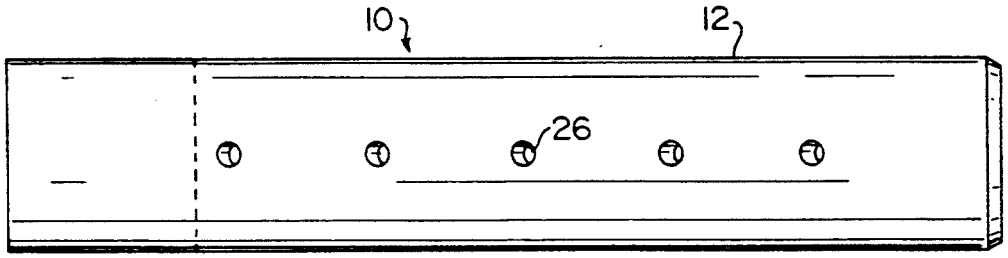
FIG. 3 is a plan view from the bottom of the apparatus.

Channels 24 are arranged along the top of cylinder member 12 such that a downward propulsive force is effected by gas exiting from channels 24. To balance out this downward force, channels 26 are disposed along the bottom of cylinder member 12 such that an upward propulsive force is effected by gas exiting from channels 26, to create a zero net propulsive force in the vertical plane. FIGS. 2 and 3 show the arrangement of the top and bottom jet channels, respectively. In order to reduce muzzle climb, a greater number of channels should be provided along the top to counteract the general upward force caused by muzzle climb. The ratio of top channels to bottom channels should be within the range of 2:1–5:1. An effective arrangement provides for 15 jet channels on top of cylinder member 12 being spaced in three rows of five each in even distance (0.257 inches) from one another with the middle row being slightly offset from the two outside rows as shown in FIG. 2, and a row of five jet channels on the bottom of cylinder 12 as shown in FIG. 3.

Vent holes 28 relieve some of the gas pressure within chamber 20 to prevent cylinder member 12 from being blown off the muzzle 32. Fewer holes are necessary when the apparatus is attached in threaded engagement. More holes are required, however, as many as eight, if the attachment is made by soldering or by cross pins.

The foregoing description of the apparatus is directed towards small bore rifles, but the principal is applicable to all firearms, including shotguns and even artillery, and this invention is considered to be directed accordingly thereto. For larger bore firearms, the diameter and length of the apparatus would be increased.

Figure 7:
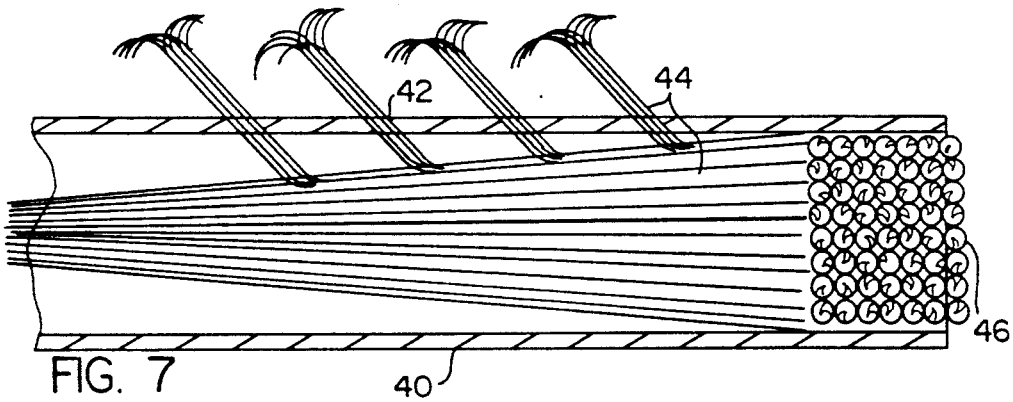
FIG. 7 is a cross sectional view of a shotgun barrel having apertures drilled therein, and showing a schematic view of the direction of travel of the discharged gases effected by the barrel modification after expulsion of the gases from the muzzle.
Figure 8:
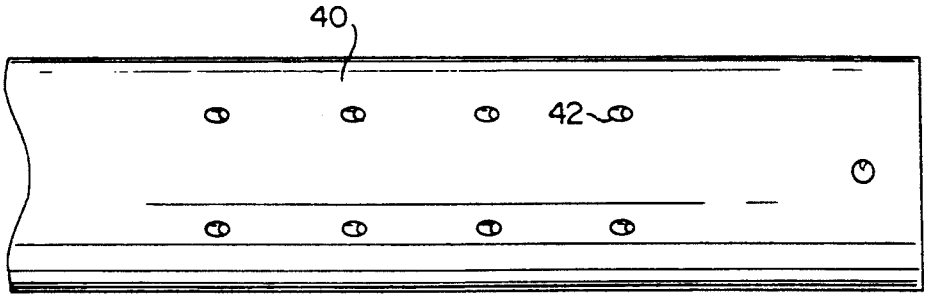
FIG. 8 is a top plan view of the shotgun barrel of FIG. 7.

The method of this invention can also be practiced directly on shotguns, without the need for a separate attachment. FIG. 7 shows channels 42 having a ⅛ inch diameter drilled into shotgun barrel 40 at a 49° angle in a similar manner as that done for apparatus 10. FIG. 7 shows a schematic representation of the travel of gases upon discharge of the shotgun. Gas 44 is forced against shot pellets 46, which deflects the gas backward and out through channels 42 creating the forward jet propulsive force which minimizes the recoil. Only top channels 42 are required when the invention is practiced on shotguns, and FIG. 8 shows a typical arrangement of channels 42 along the top surface of the shotgun barrel.

Various changes and modifications may be made within this invention as will be apparent to those skilled in the art. Such changes and modifications are within the scope and teaching of this invention as defined in the claims appended hereto.

What is claimed is:

1. An apparatus for reducing thrust generated from gas produced by the combustion of gunpowder upon the discharge of a firearm, said apparatus comprising a hollow single-chambered cylinder member having means for attachment to a muzzle end of said firearm, said cylinder having a first end and a second end, said first end being open and being attached to said muzzle end, said second end defining a restricted opening having a sufficient dimension to allow for the passage therethrough of a projectile fired from said firearm, said cylinder member having a first plurality of apertures disposed longitudinally along a top surface thereof, and a second plurality of apertures disposed longitudinally along a bottom surface opposite said first plurality of apertures, said apertures passing through said surface of said hollow cylinder member into said single chamber formed therein, said surface being of a sufficient thickness such that each of said apertures form a channel, said channel having an axis oriented rearwardly toward said first end, whereby a substantial portion of said gas is expelled rearwardly through said apertures to reduce said thrust, said second end having a plurality of vent holes disposed radially around and coaxially with said restricted opening, whereby excess pressure from said gas is relieved.

2. The apparatus of claim 1 in which said means for attachment to said muzzle end comprises said first end of said cylinder member being internally threaded for mating threaded engagement with a threaded exterior end of said muzzle.

3. The apparatus of claim 1 in which said restricted opening has a dimension 0.002–0.004 greater than a diameter of a bore of said firearm.

4. The apparatus of claim 1 in which said ratio between said first plurality of apertures and said second plurality of apertures is 3:1.

5. The apparatus of claim 4 in which said first plurality of apertures are arranged in three parallel rows, and said second plurality of apertures are arranged in a single row.

6. The apparatus of claim 5 in which an alignment of apertures of the middle row of said first plurality of apertures are staggered from the apertures of the two outer rows.

* * * * *

UNITED STATES PATENT AND TRADEMARK OFFICE

CERTIFICATE OF CORRECTION

PATENT NO. : 5,320,022

DATED : June 14, 1994

INVENTOR(S) : Kimbro, Jerold R. and Kimbro, James P.

It is certified that error appears in the above-indentified patent and that said Letters Patent is hereby corrected as shown below:

Column 4, claim 3, line 67, "Inches" should be inserted after --0.002 - 0.004--.

Signed and Sealed this

Thirtieth Day of August, 1994

*Attest:*

*Attesting Officer*

BRUCE LEHMAN

*Commissioner of Patents and Trademarks*